US006850720B2

(12) United States Patent
Schuller et al.

(10) Patent No.: US 6,850,720 B2
(45) Date of Patent: Feb. 1, 2005

(54) PRINT MEDIA OUTPUT RECEPTACLE RAIL SUPPORT AND DRIVE SYSTEM

(75) Inventors: Peter D. Schuller, Coon Rapids, MN (US); Thomas G. Lindblom, Claremont, MN (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/396,276

(22) Filed: Mar. 24, 2003

(65) Prior Publication Data

US 2004/0190930 A1 Sep. 30, 2004

(51) Int. Cl.[7] ..... G03G 15/00
(52) U.S. Cl. ..... 399/107; 399/405; 399/407
(58) Field of Search ..... 399/107, 403, 399/404, 405, 407; 271/287, 288, 292, 293, 294, 295

(56) References Cited

U.S. PATENT DOCUMENTS 5,384,634 A * 1/1995 Takehara et al. ..... 399/410
5,722,030 A * 2/1998 Kato ..... 399/403
5,742,890 A * 4/1998 Kato et al. ..... 399/403
6,041,214 A * 3/2000 Fujikura et al. ..... 399/403

* cited by examiner

*Primary Examiner*—Hoan Tran

(57) ABSTRACT

A rail support for a print media output receptacle, such as a paper tray, and a drive system for moving a print media output receptacle. In one embodiment, a frame for supporting a print media output receptacle includes a top, a bottom opposite the top and parallel side rails extending between the top and the bottom. The rails are configured to guide movement of the media output receptacle. In another embodiment, a print media output device includes a frame, a pair of vertically oriented rails disposed parallel to and opposite one another, each rail defining one side of the frame, a reversing motor supported by the frame, and a horizontally oriented output receptacle operatively coupled to the motor. The receptacle extends between and is mounted to the rails for movement thereon up and down at the urging of the motor.

10 Claims, 6 Drawing Sheets

PRINT MEDIA OUTPUT RECEPTACLE RAIL SUPPORT AND DRIVE SYSTEM

FIELD OF THE INVENTION

The invention is directed to a rail support for a print media output receptacle, such as a paper tray, and to a drive system for moving a print media output receptacle.

BACKGROUND

Printed documents are typically output by printers and post print finishing devices into a tray, bin or other receptacle. In some devices, the receptacle is driven up and down to accommodate the output of different types and sizes of documents or groups of documents. The present invention was developed in an effort to provide a comparatively low cost receptacle support and drive system for media output devices that utilize a movable output receptacle.

DETAILED DESCRIPTION

Figure 1:
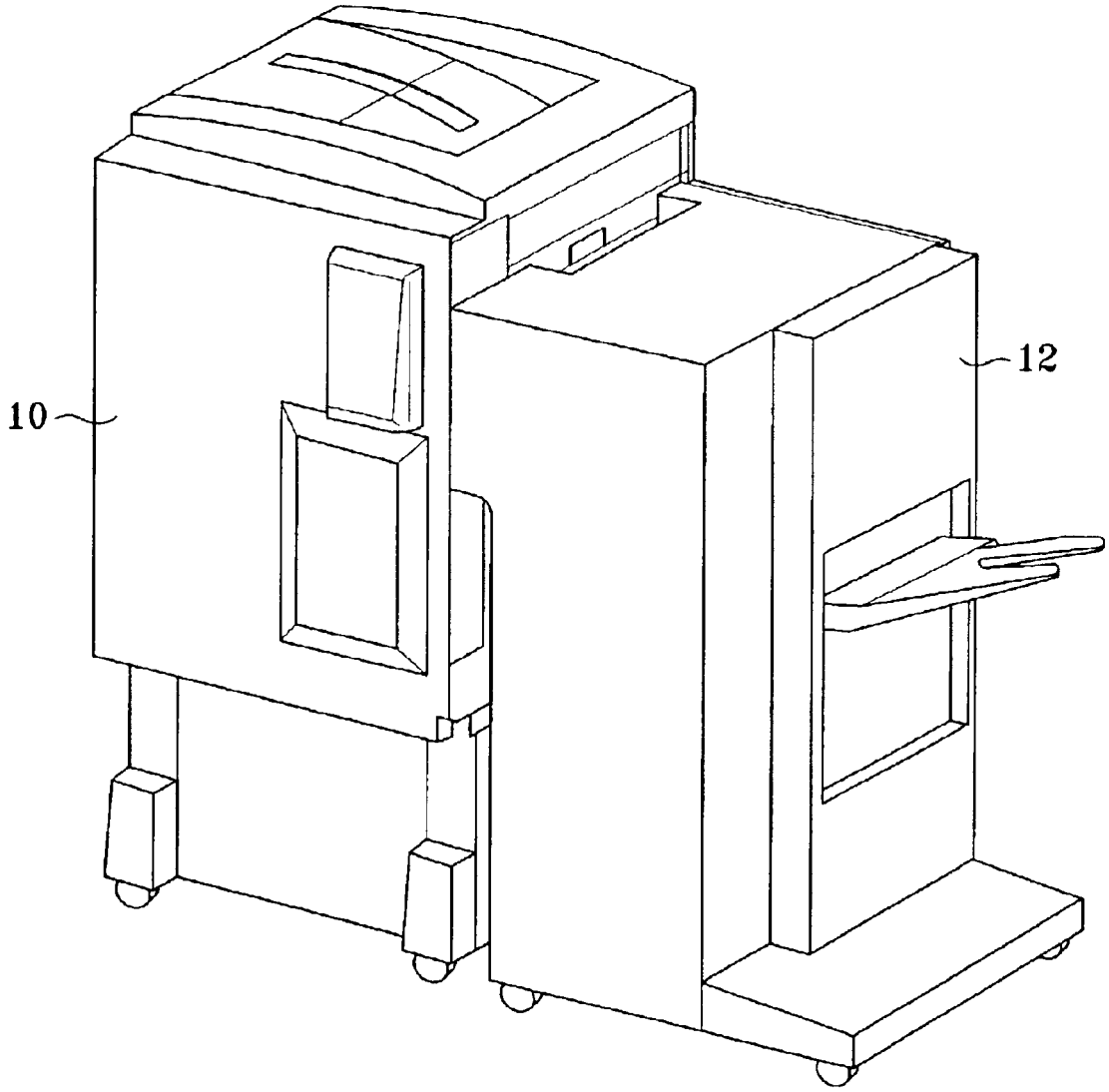
FIG. 1 is a perspective side view illustrating a printer with an attached post print finishing device.
Figure 2:
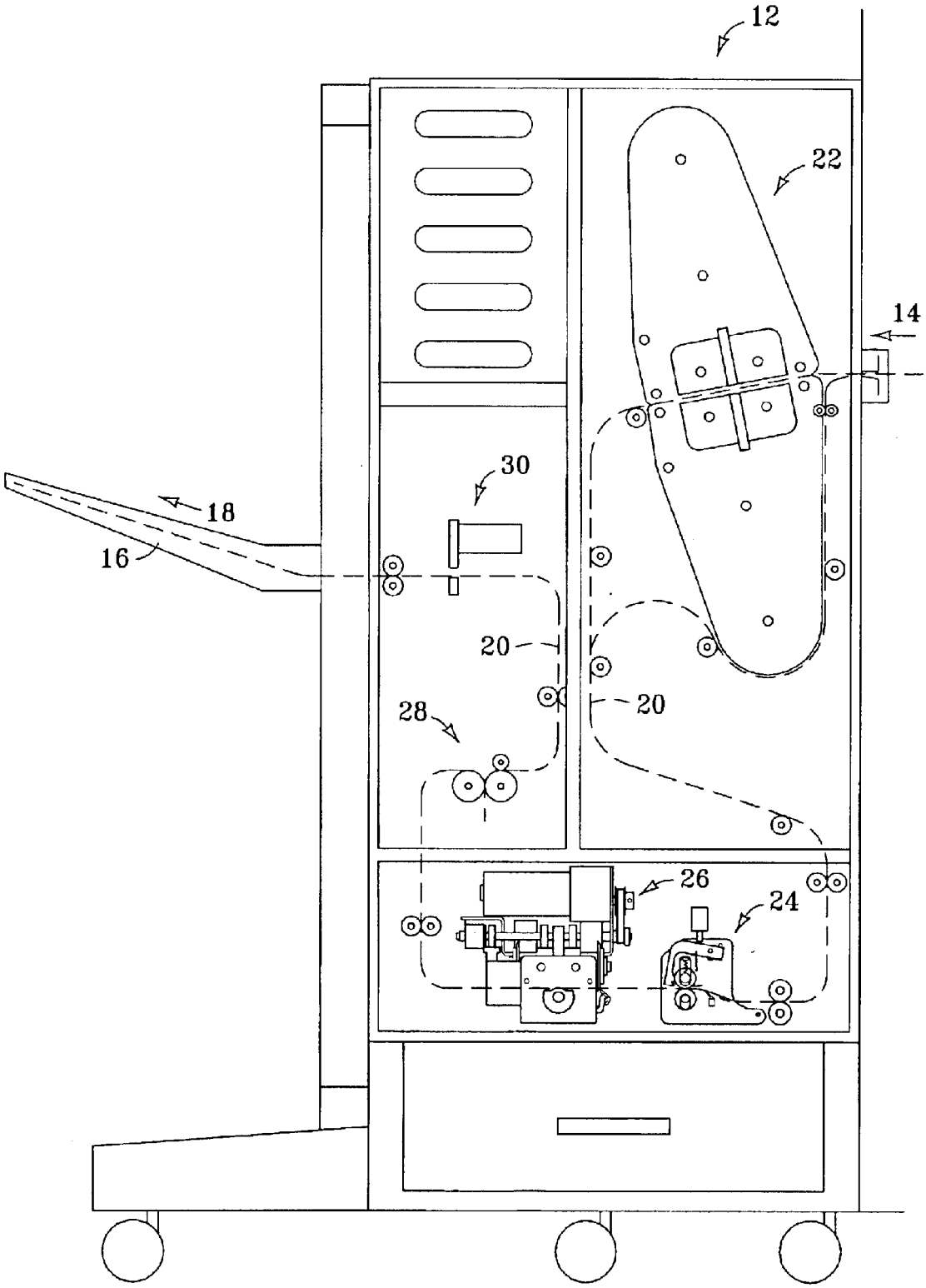
FIG. 2 is an elevation side view illustrating the major components and media path through a post print finishing device such as the one shown in FIG. 1.

FIG. 1 illustrates a printer 10 with an attached post print finishing device 12. FIG. 2 illustrates the major components and media path through a post print finishing device such as the one shown in FIG. 1. FIGS. 1–2 illustrate one exemplary environment in which embodiments of the invention may be implemented. While the finishing device of FIG. 2 includes sheet coating, trimming and stapling, and booklet making capabilities, embodiments of the invention may be used with any printer or print media output device in which it may be desirable to use a movable output tray, bin or other receptacle.

Printer is used broadly in this document to mean any printing device including, for example, laser printers, inkjet printers, copiers and multi-function devices.

Referring to FIG. 2, printed media sheets are output to finishing device 12 as noted by arrow 14, and discharged from finishing device 12 to output tray 16 as noted by arrow 18. The media path through finishing device 12 is indicated by broken line 20 in FIG. 2. Media sheets output to finishing device 12 are transported through or around coating unit 22 to a pre-trim registration unit 24, trimming unit 26, folding unit 28 and stapling unit 30 before they are discharged to output tray 16.

Coating unit 22 coats printed media with a film of clear flexible material. Such coatings can be formulated and applied to help protect the printed image, enhance the printed image or provide a more uniform gloss level across the entire media (including both printed and unprinted areas). If a coating is not desired, then media sheets are moved along a bypass path around coating unit 22. Pre-trim registration unit 24 registers each sheet to trimming unit 26 before it enters trimmer 26. That is to say, registration unit 24 straightens or "deskews" each sheet as necessary to ensure the sheet is properly aligned in the media path as it enters trimmer 26. Trimming unit 26 trims the leading edge of each sheet or the trailing edge of each sheet, or both, as necessary to make the sheet the desired size for the finished booklet or other document. Folding unit 28 folds each sheet by creasing the sheet along the desired fold line. Stapling unit 30 staples each booklet after the sheets are trimmed, folded and assembled.

Figure 3:
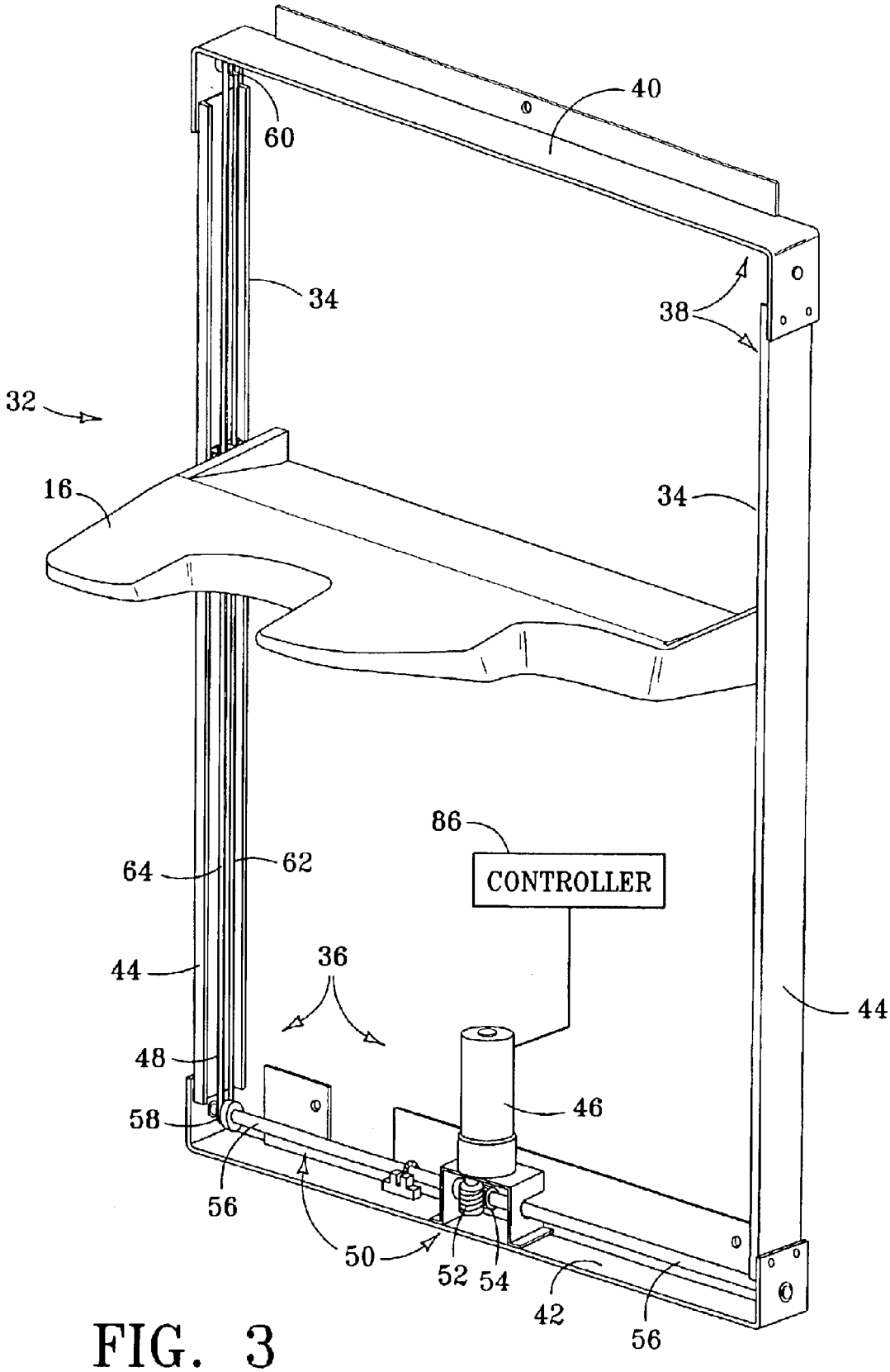
FIG. 3 is a perspective rear side view of an output device that incorporates a rail support and drive system according to one embodiment of the invention.
Figure 4:
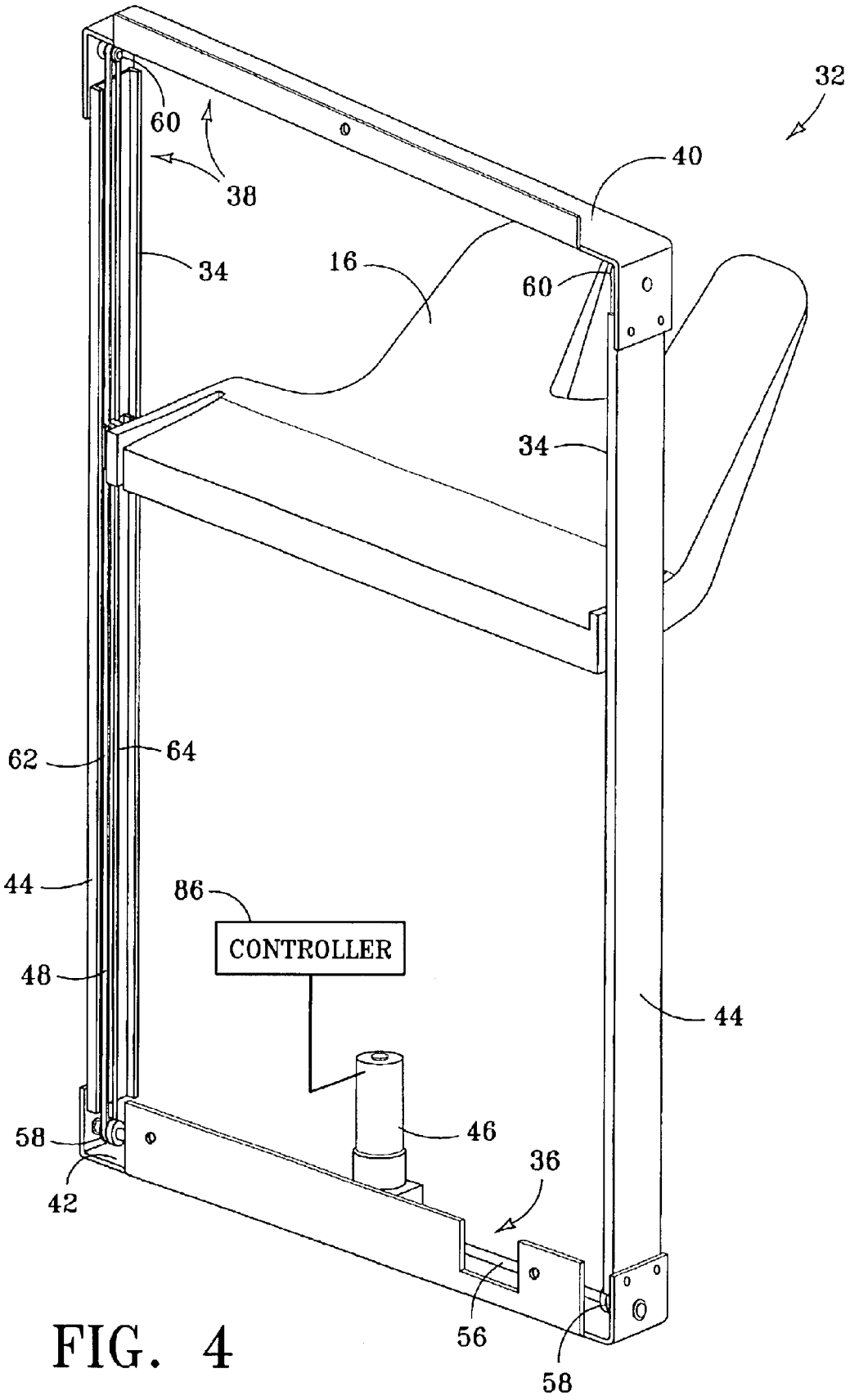
FIG. 4 is a perspective front side view of the output device of FIG. 3.
Figure 5:
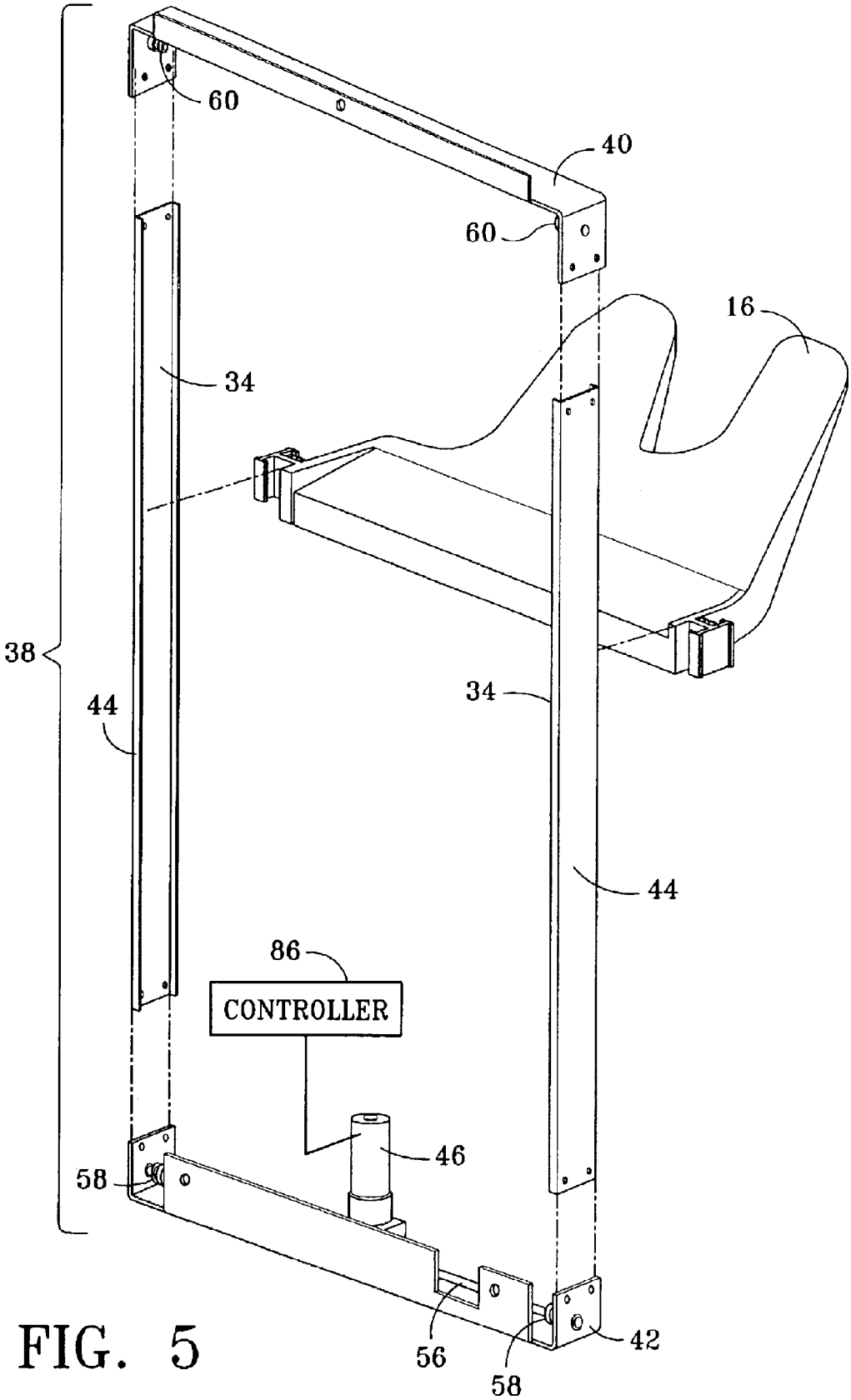
FIG. 5 is an exploded view showing the frame and output tray of the device shown in FIGS. 3 and 4.

FIGS. 3 and 4 are perspective rear and front views, respectively, of an output device 32 that incorporates output tray rails 34 and tray drive system 36 constructed according to one embodiment of the invention. FIG. 5 is an exploded view of frame 38, rails 34 and tray 16. Referring now to FIGS. 3–5, output device 32 includes output tray 16, tray drive system 36 and frame 38. Frame 38, typically rectangular, includes a top 40 and a bottom 42 that extend between sides 44. Tray drive system 36 includes a reversing motor 46, endless loop belts 48 and a drive train 50 that couples motor 46 and belts 48.

In the embodiment shown in FIGS. 3 and 4, drive train 50 includes a drive gear 52, driven gears 54, drive shafts 56, belt drive wheels 58 and belt idler wheels 60. Motor 46 is mounted to frame bottom 42. The outboard ends of drive shafts 56 are supported on bearings or bushings (not shown) in frame bottom 40. A worm gear or other suitable drive gear 52 is connected to motor 46. Spur gears or other suitable driven gears 54 are mounted to the inboard ends of shafts 56. Driven gears 54 engage drive gear 52 to turn shafts 56. Belt drive wheels 58 are mounted near the outboard ends of shafts 56 and turn with shafts 56 at the bottom of rails 34. Belt idler wheels 60 are mounted to frame 38 at the top of rails 34. Each endless loop belt 48, which wraps wheels 58 and 60, is characterized by an inner run 62 and an outer run 64.

Figure 6:
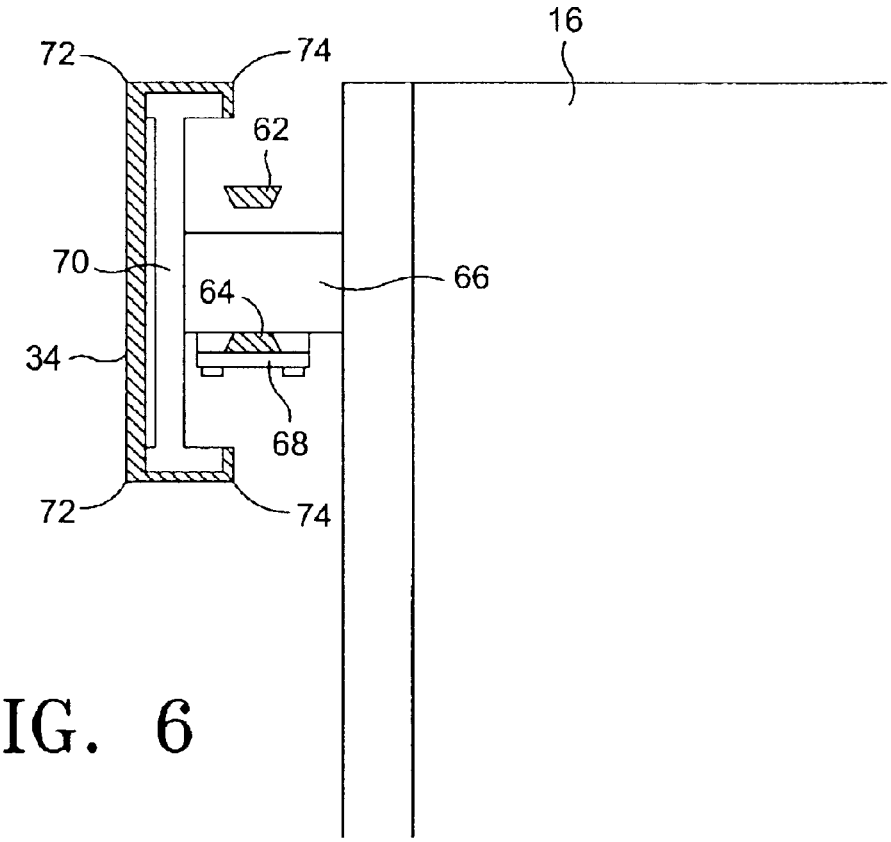
FIGS. 6 and 7 are section views showing two possible embodiments of the connection between the output tray, rail and belt of the output device shown in FIGS. 3 and 4.
Figure 7:
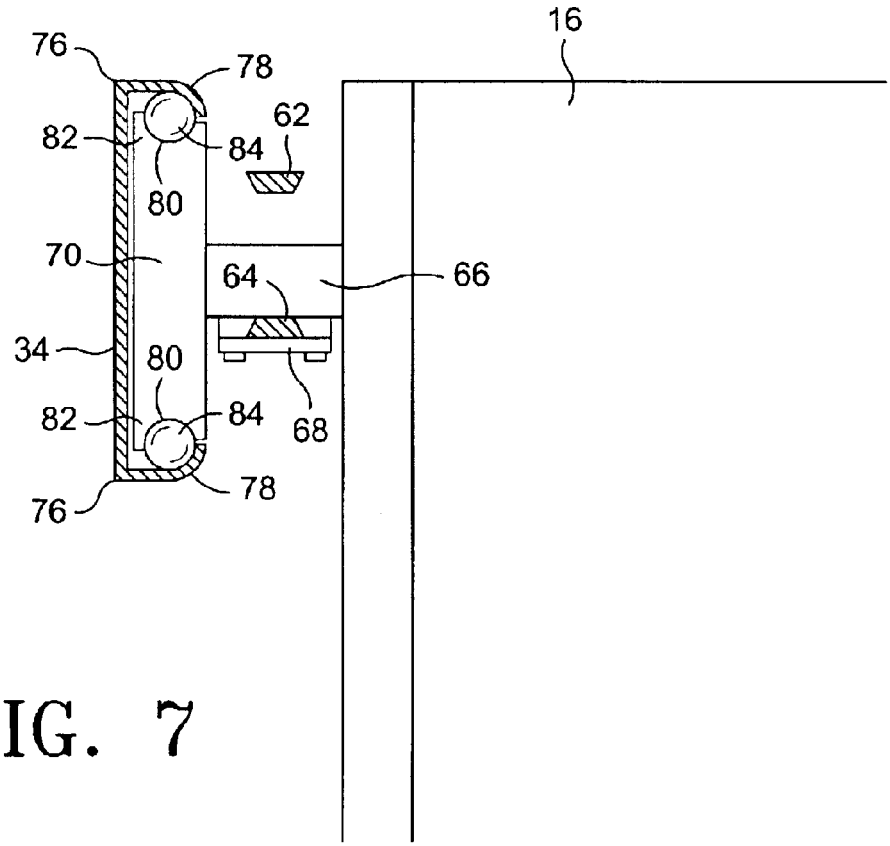

Tray 16 is mounted between and moves along rails 34 at the urging of motor 46. FIGS. 6 and 7 are section views showing two embodiments of a slide mechanism for mounting tray 16 to rails 34. Referring to FIGS. 6 and 7, a mounting post 66 extends out from tray 16 toward rail, 34. A clamp 68 clamps mounting post 66 to outer run 64 of belt 48. A slide 70 is fixed to the end of post 66. Slide 70 may be formed integral to post 66, or it may be a discrete part fastened to post 66. Rail 34 has a generally C shaped cross section characterized by square corners 72 and 74 in FIG. 6 and square and rounded corners 76 and 78 in FIG. 7. In the embodiment shown in FIG. 6, slide 70 has a generally I shaped cross section conforming to the corners 72 and 74 of rail 34 and slide 70 bears directly on rail 34. In the embodiment of FIG. 7, recesses 80 in the ends 82 of slide 70 hold ball bearings 84 and slide 70 bears indirectly on rail 34 through ball bearings 84. Recesses 80 serve as the inner race for ball bearings 84 and the rounded corners 78 of rail 34 serve as the outer race for ball bearings 84.

Rails 34 are attached to or integral with sides 44 (FIGS. 3–5). In one preferred embodiment, which is shown in the Figures, each rail 34 is coextensive with and defines each side 44. In this preferred embodiment, rail 34 functions both as the structural side of frame 38 as well as the support/guide for the travel of tray 16. Commercially available "off the shelf" linear slide rails are readily adapted for use as rails 34 to provide a lower cost option for a sorter or stacker frame.

Also, simultaneously driving both sides of tray 16 with identical drive train components (belts 48, gears 52 and 54, and wheels 58 and 60) keeps even an inexpensive plastic tray 16 properly aligned.

A programmable controller 86 (FIGS. 3–5) electrically coupled to reversing motor 46 controls the position of tray 16 through the operation of motor 46. Although it is expected that controller 86 will be implemented as part of the controller for finishing device 12 shown in FIGS. 1 and 2, controller 86 could also be implemented as a discrete output device controller or as part of the printer controller for systems in which the printer controller controls print and post print operations or in systems in which the printer outputs directly to tray 16. As with conventional printer and finishing device controllers, controller 86 will typically include a processor and associated memory. Random access memory (RAM) or other suitable operational memory contains job data from the attached printer or host computer along with programming and other data currently being executed or used by the processor. Read only memory (ROM) or other suitable operational/storage memory contains the device firmware that provides programming instructions to control the operation of finishing device 12 and output device 32. Controller 86 executes firmware-programming instructions according to command inputs from the attached printer or host computer and in response to input from sensors and other components of finishing device 12 and output device 32.

The exemplary embodiments shown in the figures and described above illustrate but do not limit the invention. Other forms, details, and embodiments may be made and implemented. Hence, the foregoing description should not be construed to limit the spirit and scope of the invention, which is defined in the following claims.

What is claimed is:

1. A print media output device, comprising:

a frame;

a pair of vertically oriented rails disposed parallel to and opposite one another, each rail defining one side of the frame;

a reversing motor supported by the frame; and a horizontally oriented output receptacle operatively coupled to the motor, the receptacle extending between and mounted to the rails for movement thereon up and down at the urging of the motor.

2. The device of claim 1, wherein a first side of the output receptacle is mounted to one rail and a second side of the output receptacle is mounted to the other rail and wherein the device further comprises:

a first drive train operatively coupled between the motor and the first side of the output receptacle;

a second drive train operatively coupled between the motor and the second side of the output receptacle; and the first drive train operationally identical to the second drive train such that both sides of the output receptacle move together at the urging of the motor.

3. The device of claim 2, further comprising a slide attached to each side of the output receptacle, each slide mounting one side of the receptacle to a rail.

4. The device of claim 3, wherein each slide includes an outside perimeter conforming to an inside perimeter of the rail.

5. The device of claim 4, wherein the inside perimeter of each rail is generally C shaped.

6. The device of claim 3, further comprising ball bearings interposed between the slides and the rails.

7. The device of claim 6, wherein an inside perimeter of each rail is generally C shaped and the bell bearings are disposed within the C shaped perimeter.

8. The device of claim 1, wherein the motor is supported by the frame at a location between the rails.

9. A print media output device, comprising:

a frame;

a pair of vertically oriented rails disposed parallel to and opposite one another, each rail defining one side of the frame;

a reversing motor supported by the frame; and a horizontally oriented output receptacle having a first side mounted to one rail and a second side mounted to the other rail;

a first drive train operatively coupled between the motor and the first side of the output receptacle;

a second drive train operatively coupled between the motor and the second side of the output receptacle; and the first drive train operationally identical to the second drive train such that both sides of the output receptacle move together at the urging of the motor.

10. The device of claim 9, wherein:

each drive train comprises a drive shaft having a first end coupled to the motor and a second end, a belt drive wheel connected to the second end of the shaft, a belt idler wheel spaced apart from the belt drive wheel, and an endless loop belt wrapping the drive wheel and the idler wheel; and each side of the output receptacle is fastened to one run of each belt.

* * * * *